US009261814B2

(12) United States Patent
Hagiwara et al.

(10) Patent No.: US 9,261,814 B2
(45) Date of Patent: Feb. 16, 2016

(54) DEVELOPER CARRYING MEMBER, DEVELOPING ASSEMBLY, PROCESS CARTRIDGE, AND IMAGE FORMING APPARATUS

(71) Applicant: CANON KABUSHIKI KAISHA, Tokyo (JP)

(72) Inventors: Kazunari Hagiwara, Yokohama (JP); Tatsuaki Orihara, Tokyo (JP); Shuhei Tokiwa, Tokyo (JP); Yasuyuki Matsumoto, Kawasaki (JP); Manami Haraguchi, Yokohama (JP); Atsushi Nakamoto, Tokyo (JP); Yasuhiro Horiguchi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/532,487

(22) Filed: Nov. 4, 2014

(65) Prior Publication Data

US 2015/0132032 A1 May 14, 2015

(30) Foreign Application Priority Data

Nov. 13, 2013 (JP) ..... 2013-235292

(51) Int. Cl.
*G03G 15/08* (2006.01)

(52) U.S. Cl.
CPC ..... *G03G 15/0818* (2013.01)

(58) Field of Classification Search
USPC ..... 399/286
See application file for complete search history.

(56) References Cited

U.S. PATENT DOCUMENTS

| | | | | |
|---|---|---|---|---|
| 5,084,369 | A | 1/1992 | Tanaka et al. | |
| 5,214,208 | A | 5/1993 | Tanaka et al. | |
| 7,745,088 | B2 * | 6/2010 | Yoshizaki | G03G 9/0806 430/108.1 |
| 2006/0056881 | A1 * | 3/2006 | Kim | G03G 15/0818 399/286 |
| 2012/0237270 | A1 | 9/2012 | Juri et al. | |
| 2015/0132030 | A1 * | 5/2015 | Orihara | G03G 15/065 399/285 |

FOREIGN PATENT DOCUMENTS

| | | | |
|---|---|---|---|
| JP | 7-31454 | B2 | 4/1995 |
| JP | 2006-215532 | A | 8/2006 |
| JP | 2008-310030 | A | 12/2008 |

OTHER PUBLICATIONS

U.S. Appl. No. 14/532,402, filed Nov. 4, 2014. Inventor: Hagiwara, et al.
European Search Report dated Mar. 11, 2015 in European Application No. 14192768.1.

* cited by examiner

*Primary Examiner* — Clayton E Laballe
*Assistant Examiner* — Linda B Smith
(74) *Attorney, Agent, or Firm* — Fitzpatrick, Cella, Harper and Scinto

(57) ABSTRACT

A developing roller that is capable of carrying toner on a surface thereof, and that supplies the toner carried on the surface to a surface of a photosensitive drum when a voltage is applied thereto, includes: an elastic layer; and a surface layer that covers the elastic layer and contains aluminum oxide, wherein the aluminum oxide of the surface layer contains tetracoordinated aluminum atoms and hexacoordinated aluminum atoms existing in a higher proportion than the tetracoordinated aluminum atoms.

10 Claims, 8 Drawing Sheets

DEVELOPER CARRYING MEMBER, DEVELOPING ASSEMBLY, PROCESS CARTRIDGE, AND IMAGE FORMING APPARATUS

BACKGROUND OF THE INVENTION

1. Field of the Invention

The present invention relates to a developer carrying member, a developing assembly, a process cartridge, and an image forming apparatus.

2. Description of the Related Art

A conventional image forming apparatus using an electrophotographic system includes a photosensitive drum serving as an image bearing member and a developing roller serving as a developer carrying member. In this image forming apparatus, a development process for visualizing a latent image formed on the photosensitive drum is performed by transferring toner serving as a developer carried on the developing roller to the latent image.

As a conventional developing system using a single-component toner, a contact developing system using a developing roller having an elastic layer has been proposed. In a region (referred to hereafter as a non-image portion) of the photosensitive drum where the toner is not to be transferred, within a contact region (referred to hereafter as a developing nip portion) where the photosensitive drum contacts the developing roller, a voltage is applied so that the toner receives a force traveling from the photosensitive drum toward the developing roller.

Here, non-image portion contamination (referred to hereafter as fog) may occur when the toner is transferred to the non-image portion of the photosensitive drum, where the toner is not intended to be transferred. Fog is generated when a charge of the toner decays or a polarity of the toner reverses in the developing nip portion where the photosensitive drum contacts the developing roller. It is known that a charge-providing performance in relation to the toner deteriorates particularly in a high humidity environment. When the charge-providing performance in relation to the toner deteriorates, the charge of the toner decays, leading to an increase in the amount of fog.

Japanese Patent Publication No. H7-31454 proposes setting a volume resistance of the developing roller at or above a predetermined value in order to suppress the occurrence of fog in which toner is transferred onto a non-image portion of a photosensitive drum.

SUMMARY OF THE INVENTION

However, when the volume resistance of the developing roller is simply increased, a development performance deteriorates due to a reduction in density and so on.

Hence, in consideration of the problems described above, an object of the present invention is to suppress the occurrence of fog while maintaining a favorable development performance.

To achieve this object, a developer carrying member according to the present invention that is capable of carrying a developer on a surface thereof, and that supplies the developer carried on the surface to a surface of an image bearing member when a voltage is applied thereto, comprising:

an elastic layer; and a surface layer that covers the elastic layer and contains aluminum oxide, wherein the aluminum oxide of the surface layer contains tetracoordinated aluminum atoms and hexacoordinated aluminum atoms existing in a higher proportion than the tetracoordinated aluminum atoms.

Further, a developing assembly according to the present invention comprising:

a developer container housing a developer; and the developer carrying member.

Further, a process cartridge according to the present invention that can be attached to a main body of an image forming apparatus detachably in order to perform an image formation process, comprising:

an image bearing member capable of bearing a developer image; and the developer carrying member, which forms the developer image by developing an electrostatic latent image on the image bearing member.

Further, an image forming apparatus according to the present invention comprising:

an image bearing member capable of bearing a developer image;

the developer carrying member, which forms the developer image by developing an electrostatic latent image on the image bearing member; and applying means for applying a voltage to the developer carrying member.

According to the present invention, the occurrence of fog can be suppressed while maintaining a favorable development performance.

Further features of the present invention will become apparent from the following description of exemplary embodiments with reference to the attached drawings.

DESCRIPTION OF THE EMBODIMENTS

Embodiments of the present invention will be described using examples with reference to the drawings. Dimensions, materials and shapes of the components and relative configurations thereof according to the embodiments should be appropriately changed in accordance with the configuration and various conditions of the apparatus to which the invention is applied. In other words, the following embodiments are not intended to limit the scope of the present invention.

First Embodiment

Figure 1:
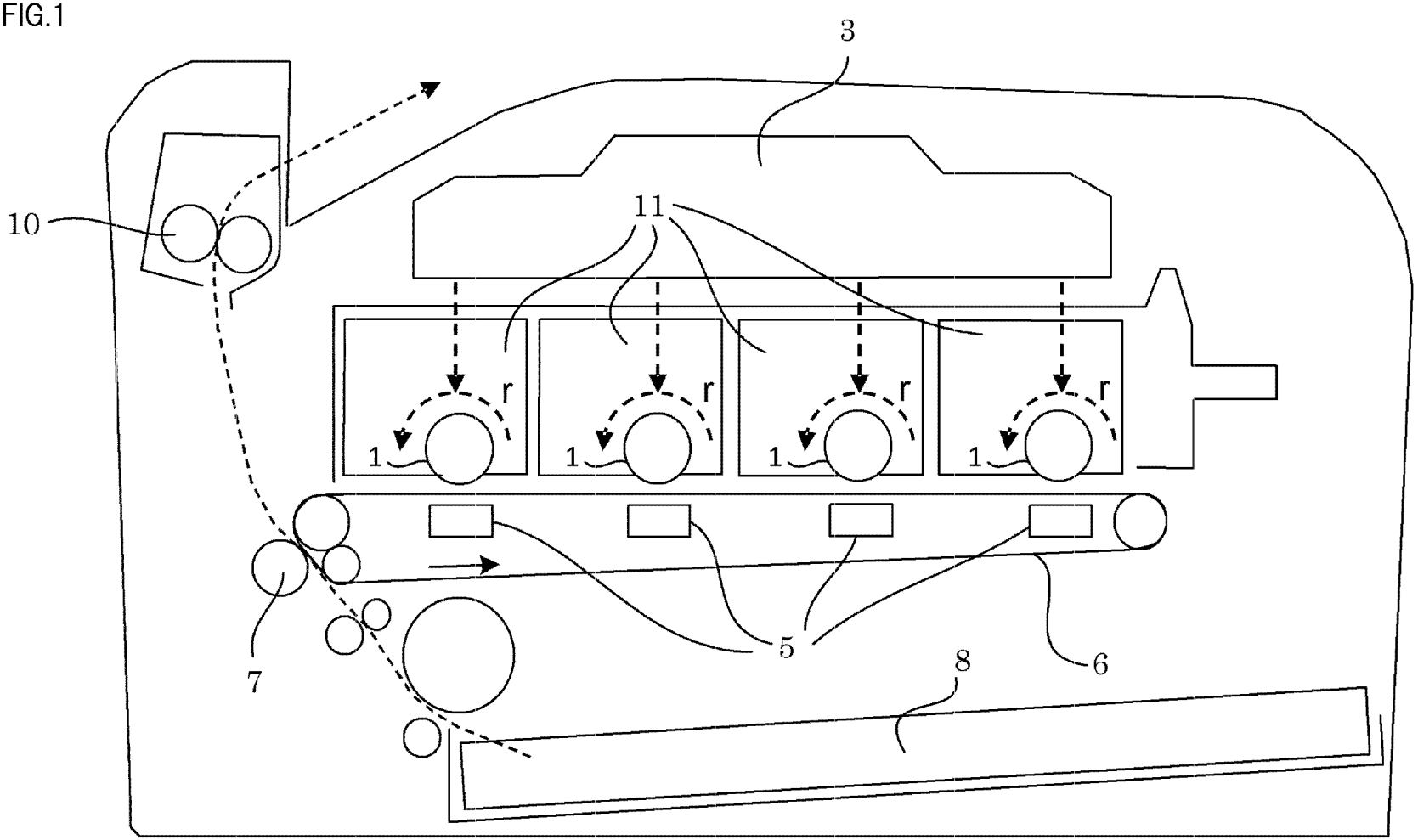
FIG. 1 is a schematic sectional view showing a configuration of an image forming apparatus according to an embodiment.
Figure 2:
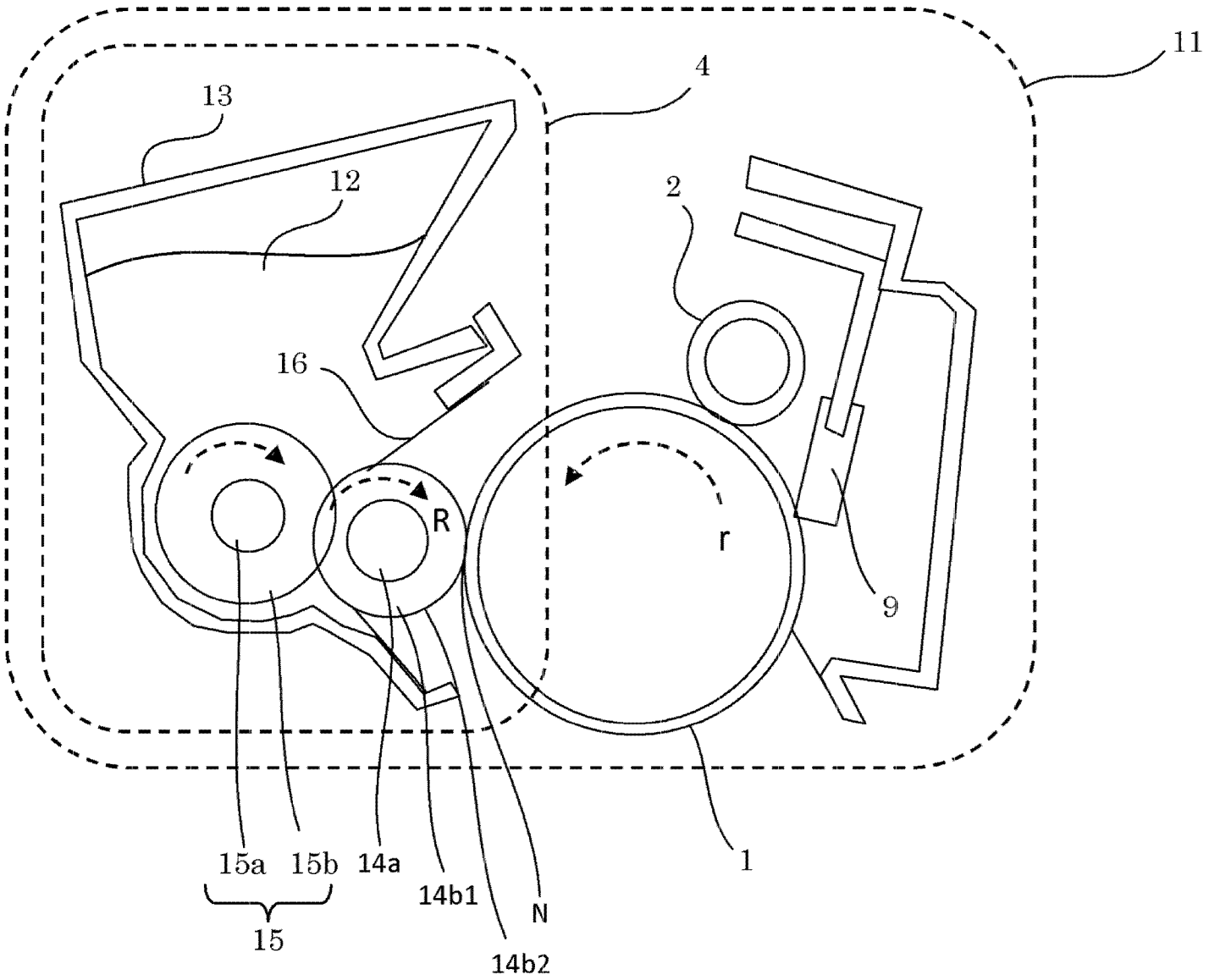
FIG. 2 is a schematic sectional view showing a configuration of a cartridge according to a first embodiment.

A first embodiment will be described with reference to FIGS. 1 and 2. FIG. 1 is a schematic sectional view showing a configuration of an image forming apparatus according to first and second embodiments. FIG. 2 is a schematic sectional view showing a configuration of a cartridge according to the first embodiment.

As shown in FIG. 1, the image forming apparatus includes a laser optical apparatus 3 serving as an exposure device, a primary transfer apparatus 5, an intermediate transfer member 6, a secondary transfer apparatus 7, and a fixing apparatus 10. The image forming apparatus also includes a process cartridge (referred to hereafter simply as a cartridge) 11 that performs an image forming process and can be attached to and detached from an apparatus main body. As shown in FIG. 2, the cartridge 11 includes a photosensitive drum 1 serving as an image bearing member capable of bearing a latent image, a charging roller 2 serving as a charging device, a developing assembly 4, and a cleaning blade 9.

The photosensitive drum 1 is provided to be capable of rotating in a direction of an arrow r in FIG. 2, and a surface of the photosensitive drum 1 is charged to a uniform surface potential Vd by the charging roller 2 (a charging process). By emitting a laser beam from the laser optical apparatus 3, an electrostatic latent image is formed on the surface of the photosensitive drum 1 (an exposure process). Further, by supplying toner from the developing assembly 4 as a developer, the electrostatic latent image is visualized as a toner image serving as a developer image (a development process).

The visualized toner image on the photosensitive drum 1 (on the image bearing member) is transferred onto the intermediate transfer member 6 by the primary transfer apparatus 5, and then transferred onto a sheet 8 serving as a recording medium by the secondary transfer apparatus 7 (a transfer process). Here, untransferred toner that remains on the photosensitive drum 1 having not been transferred in the transfer process is scraped away by the cleaning blade 9 (a cleaning process). After the surface of the photosensitive drum 1 has been cleaned, the charging process, exposure process, development process, and transfer process described above are repeated. Meanwhile, the toner image transferred onto the sheet 8 is fixed by the fixing apparatus 10, whereupon the sheet 8 is discharged to the exterior of the image forming apparatus.

In the first embodiment, the apparatus main body is provided with four attachment portions to which the cartridge 11 is attached. Cartridges 11 filled respectively with yellow, magenta, cyan, and black toner are attached in order from an upstream side of a movement direction of the intermediate transfer member 6, and a color image is formed by transferring the toner in the respective colors in sequence onto the intermediate transfer member 6.

The photosensitive drum 1 is formed by laminating an organic photoreceptor coated sequentially with a positive charge injection prevention layer, a charge generation layer, and a charge transport layer onto an aluminum (Al) cylinder serving as a conductive substrate. Arylate is used as the charge transfer layer of the photosensitive drum 1, and a film thickness dP of the charge transport layer is regulated to 23 μm. The charge transport layer is formed by dissolving a charge transporting material into a solvent together with a binder. Examples of organic charge transporting materials include acryl resin, styrene resin, polyester, polycarbonate resin, polyarylate, polysulphone, polyphenylene oxide, epoxy resin, polyurethane resin, alkyd resin, and unsaturated resin. These charge transporting materials may be used singly or in combinations of two or more.

The charging roller 2 is formed by providing a semiconductive rubber layer on a core metal serving as a conductive support member. The charging roller 2 exhibits a resistance of approximately $10^5\Omega$ when a voltage of 200 V is applied to the conductive photosensitive drum 1.

As shown in FIGS. 2A and 2B, the developing assembly 4 includes a developer container 13, a developing roller 14 serving as a developer carrying member capable of carrying toner, a supply roller 15, and a regulating blade 16 serving as a regulating member. Toner 12 serving as a developer is housed in the developer container 13. The developing roller 14 is provided to be capable of rotating in a direction of an arrow R in FIG. 2. The supply roller 15 supplies the toner 12 to the developing roller 14. The regulating blade 16 regulates the toner on the developing roller 14 (on the developer carrying member). Further, the supply roller 15 is provided to be capable of rotating while contacting the developing roller 14, and one end of the regulating blade 16 contacts the developing roller 14.

The supply roller 15 is configured by providing a urethane foam layer 15*b* around a core metal electrode 15*a* that has an outer diameter of ϕ 5.5 mm and serves as a conductive support member. An overall outer diameter of the supply roller 15, including the urethane foam layer 15*b*, is ϕ 13 mm. A penetration level of the supply roller 15 relative to the developing roller 14 is 1.2 mm. In a contact region between the supply roller 15 and the developing roller 14, the supply roller 15 and the developing roller 14 rotate in directions having mutually opposite direction speeds. A powder pressure of the toner 12 existing on the periphery of the urethane foam layer 15*b* acts on the urethane foam layer 15*b*, and when the supply roller 15 rotates, the toner 12 is taken into the urethane foam layer 15*b*. The supply roller 15 containing the toner 12 supplies the toner 12 to the developing roller 14 in the contact region with the developing roller 14, and by rubbing against the toner 12, applies a preliminary triboelectric charging charge to the toner 12. Meanwhile, in a contact region (referred to hereafter as a developing nip portion) N between the photosensitive drum 1 and the developing roller 14, the supply roller 15 also serves to peel away the toner that remains on the developing roller 14 having not been supplied to the photosensitive drum 1.

As the developing roller 14 rotates, the toner 12 supplied to the developing roller 14 from the supply roller 15 reaches the regulating blade 16, where the toner 12 is regulated to a desired charge amount and a desired layer thickness. The regulating blade 16 is a stainless steel (SUS) blade having a thickness of 80 μm, and is disposed in a reverse orientation (in a counter direction) to the rotation of the developing roller 14. Further, a voltage is applied to the regulating blade 16 so that a potential difference of 200 V is generated relative to the developing roller 14. This potential difference is required to stabilize coating of the toner 12. A toner layer (a developer layer) formed on the developing roller 14 by the regulating blade 16 is conveyed to the developing nip portion N, and subjected to reversal development in the developing nip portion N.

The penetration level of the developing roller 14 relative to the photosensitive drum 1 is set at 40 μm by a roller, not shown in the drawings, provided on an end portion of the developing roller 14. The surface of the developing roller 14 deforms when pressed against the photosensitive drum 1 to form the developing nip portion N, whereby development can be performed in a stable contact state. Further, in the developing nip portion N where the developing roller 14 contacts the photosensitive drum 1, the developing roller 14 rotates in an identical direction (the R direction) to the rotation direction (the r direction) of the photosensitive drum 1 at a circumferential speed ratio of 117% relative to the photosensitive drum 1. In other words, the photosensitive drum 1 is provided to be capable of rotating such that a surface movement direction thereof in the developing nip portion N is identical to the developing roller 14, while the developing roller 14 rotates at a higher rotation speed than the photosensitive drum 1. This circumferential speed difference is provided in order to apply a shearing force to the toner, thereby reducing a substantive attachment force thereof so that controllability by means of an electric field is improved.

Specific voltages constituting the first embodiment will now be described. By applying −1050 V to the charging roller 2, the surface of the photosensitive drum 1 is charged uniformly to −500 V, and as a result, a dark potential Vd is formed. A potential (a light potential V1) of an image portion in which an image is formed is adjusted to −100 V by the laser optical apparatus 3. By applying a voltage of −300 V to the developing roller 14 at this time, the negative polarity toner is transferred to the image portion (the region of the light potential V1), whereby reversal development is performed. Further, |Vd−Vdc| will be referred to as Vback, and Vback is set as 200 V. Incidentally, the image forming apparatus according to this embodiment has a power supply serving as applying means for applying a voltage to the developing roller 14.

In the first embodiment, single component, non-magnetic toner is used as the toner 12 serving as the developer. The toner 12 is adjusted so as to contain a binder resin and a charge control agent, and manufactured to have negative polarity by adding a fluidizing agent or the like thereto as an external additive. Furthermore, the toner 12 is manufactured using a polymerization method, and regulated to an average particle size of approximately 5 μm.

Further, an amount of toner charged into the developer container 13 of the developing assembly 4 is set at an amount enabling printing of 3000 sheets of a converted image having an image ratio of 5%. An image formed by repeatedly printing one dot line and leaving nineteen dot lines unprinted may be cited as a specific example of horizontal lines having an image ratio of 5%.

During the image forming process, the photosensitive drum 1 is driven to rotate by the image forming apparatus at a rotation speed of 120 mm/sec in the direction of an arrow r in the drawings. Further, the image forming apparatus according to this embodiment includes a low speed mode in which the process speed is set at 60 mm/sec, which is lower than the normal speed, in order to secure an amount of heat required to perform fixing during passage of a thick recording sheet (a thick sheet). Note that in this embodiment, operations are performed in only two process modes, but depending on the thickness of the recording sheet and so on, a plurality of process modes may be provided so that control corresponding to the respective process modes can be executed.

Second Embodiment

Figure 3:
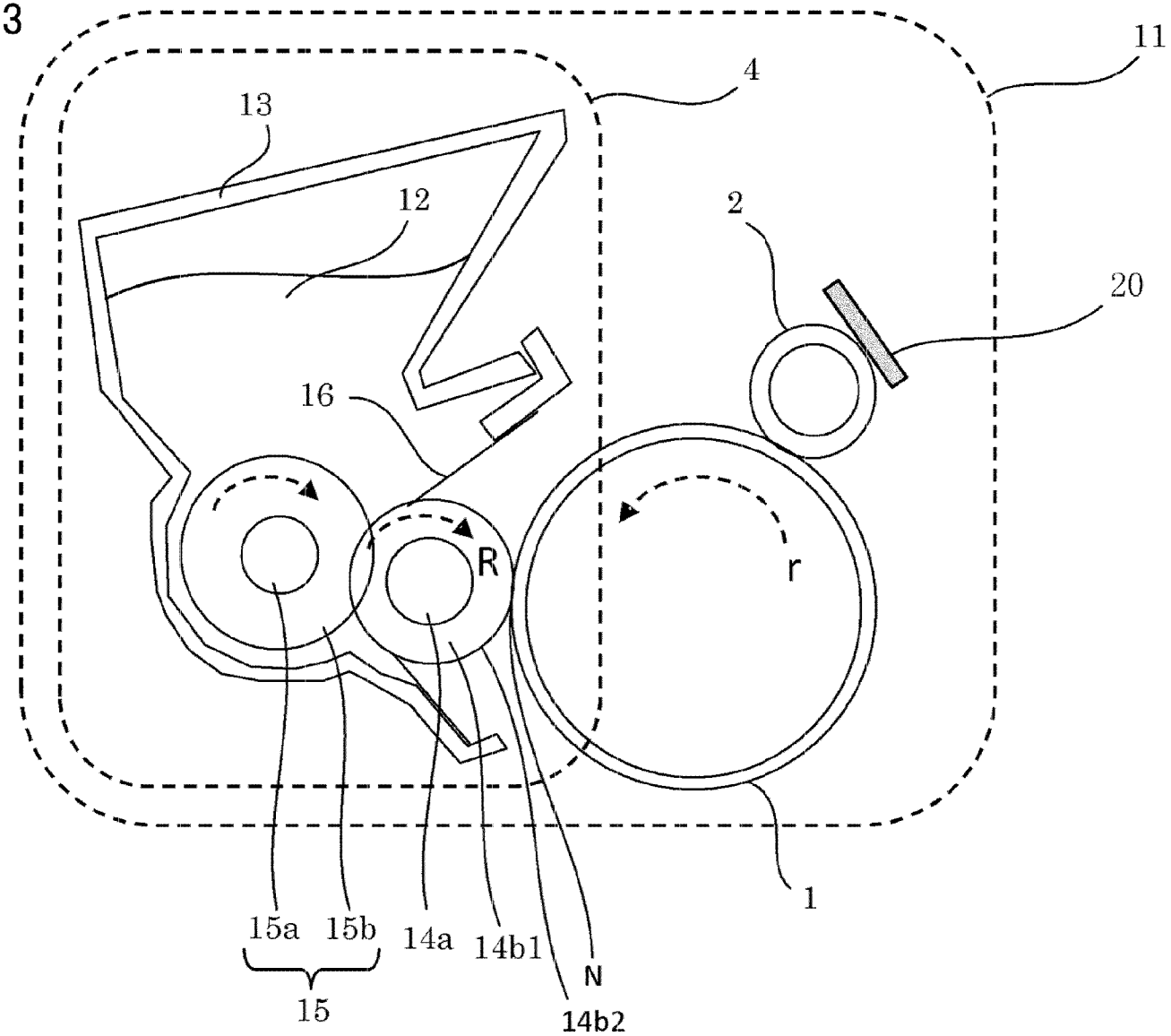
FIG. 3 is a schematic sectional view showing a configuration of a cartridge according to a second embodiment.

Next, referring to FIG. 3, a second embodiment will be described. FIG. 3 is a schematic sectional view showing a configuration of a cartridge according to the second embodiment. An image forming apparatus according to the second embodiment is a laser printer that uses a transfer type electrophotographic process and includes a toner recycling process (a cleanerless system). Duplicate description of points that are identical to the image forming apparatus of the first embodiment, described above, has been omitted, and only differences will be described below. The main difference with the first embodiment is that the cleaning blade 9 that cleans the photosensitive drum 1 is omitted, and the untransferred toner is recycled. The untransferred toner is circulated so as not to adversely affect the other processes such as charging, and collected in the developing assembly 4. More specifically, the configuration of the first embodiment is modified as follows.

As regards charging, a similar charging roller to the charging roller 2 of the first embodiment is used, but a charging roller contact member 20 is provided with the aim of preventing the charging roller 2 from being soiled by toner. A 100 μm polyimide film is used as the charging roller contact member 20, and the polyimide film contacts the charging roller 2 at a linear pressure of no more than 10 (N/m). Polyimide is used because it possesses a triboelectric charging characteristic for applying a negative charge to the toner. Even when the charging roller 2 is soiled by toner having a reverse polarity (positive polarity) to the charging polarity thereof, the charging roller contact member 20 switches the charge of the toner from positive to negative so that the charging roller 2 can expel the toner quickly and the expelled toner can be collected in the developing assembly 4.

Further, to improve the toner collecting performance of the developing assembly 4, an absolute value of the dark potential Vd and the value of Vback were set to be large. More specifically, the surface of the photosensitive drum 1 is set at a uniform surface potential Vd of −800 V by setting the voltage applied to the charging roller 2 at −1350 V. Furthermore, Vback is set at 500 V by setting a developing bias at −300 V.

First Example

Figure 4:
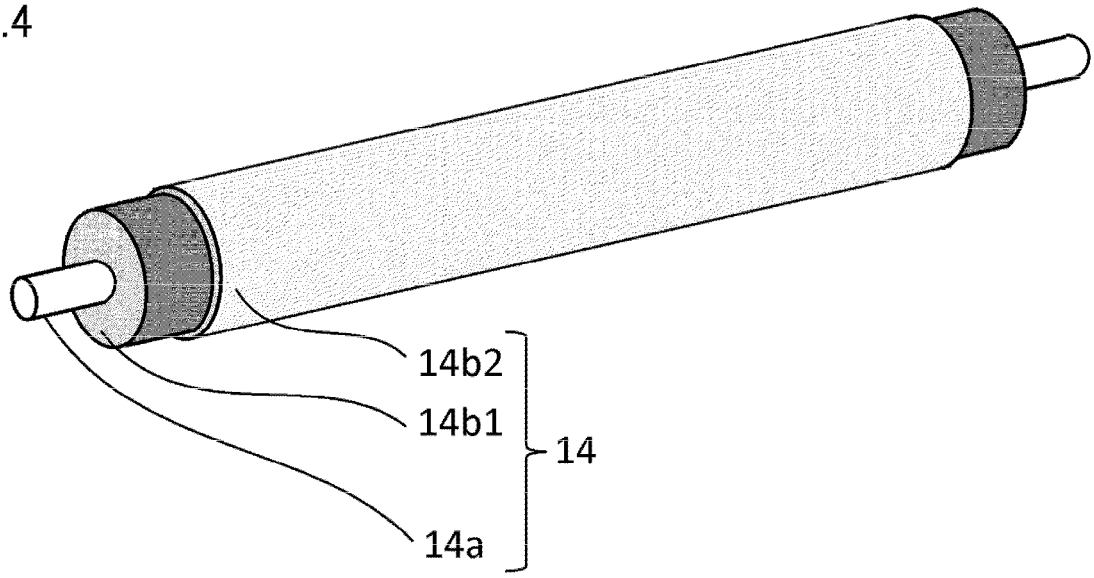
FIG. 4 is a perspective view showing a developing roller according to a first example.

Next, using FIG. 4, a developing roller 14 according to a first example will be described. FIG. 4 is a perspective view showing the developing roller according to the first example. The developing roller used in this example, shown in FIG. 4, was manufactured as follows.

A conductive rubber layer **14*b*1 containing a conductive agent was provided on a periphery of a core metal electrode 14*a*** having an outer diameter of ϕ6 mm and serving as a conductive support member, whereby an outer diameter of ϕ11.5 mm was obtained. Here, any typical type of rubber, such as silicon rubber, urethane rubber, ethylene propylene copolymer (EPDM), hydrin rubber, or a mixture thereof, may be used as the material of the rubber layer.

In the first example, the rubber layer **14*b*1 was formed from 2.5 mm of silicon rubber and a 10 μm urethane layer. A desired resistance value can be obtained by dispersing carbon particles, metal particles, ion conduction particles, or the like through the rubber layer 14*b*1 as the conductive agent, and in the first example, carbon particles were used. Further, the rubber layer 14*b*1 was manufactured to a have a desired hardness by adjusting the amount of silicon rubber and an amount of silica serving as a filler in order to adjust the overall hardness of the developing roller 14**.

Furthermore, an aluminum oxide film **14*b*2 of approximately 300 nm was formed as a surface layer by performing vacuum deposition on the manufactured rubber layer 14*b*1. More specifically, the aluminum oxide film 14*b*2 was formed by vaporizing Al2O3 granules through electron beam heating in a vacuum so that the vaporized Al2O3 granules were laminated onto the surface of the rubber layer 14*b*1**.

Here, during material analysis of the surface layer, the existence of aluminum and oxygen was confirmed by X-ray photoelectron spectroscopy (XPS), whereupon respective proportions of conditions in which four, five, and six oxygen atoms are coordinated around an aluminum atom were calculated using solid-state nuclear magnetic resonance (solid-state NMR).

Figure 8:
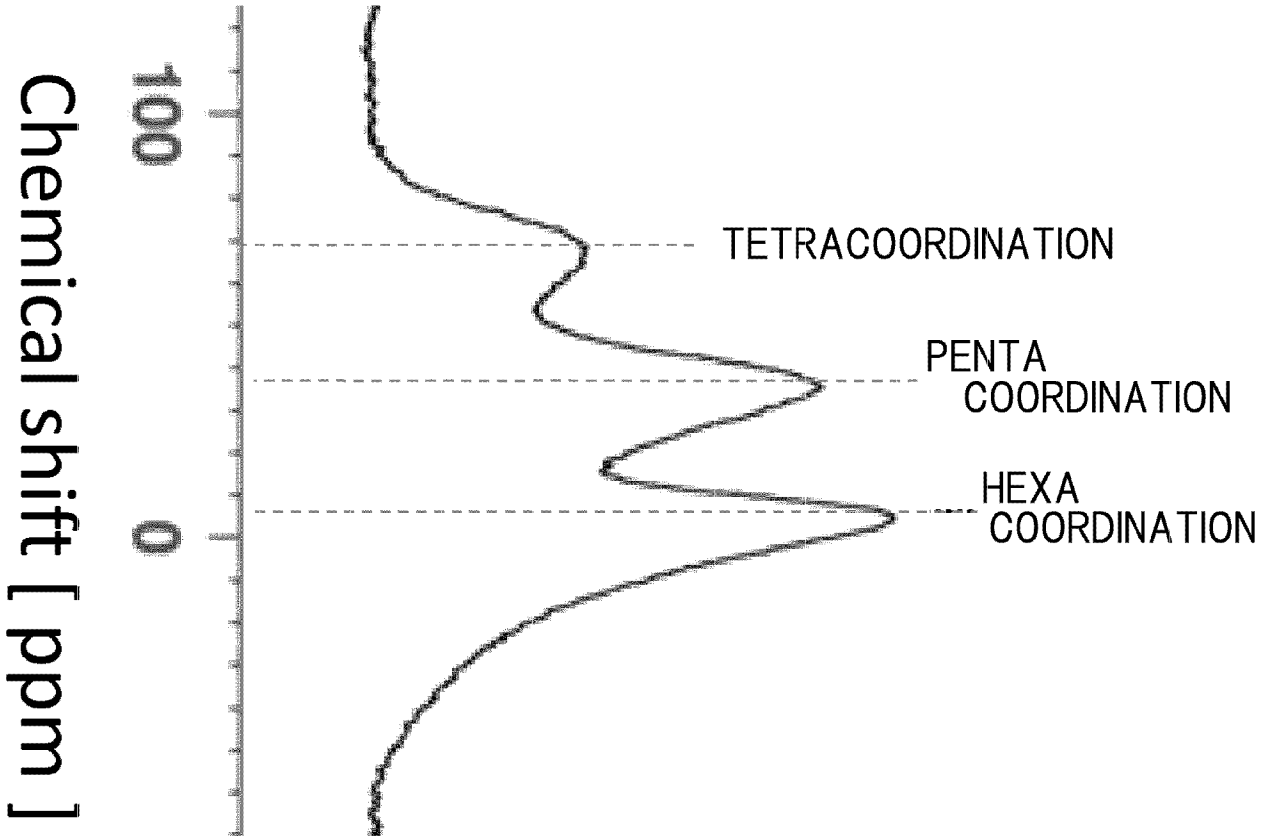
FIG. 8 is a graph showing an example of NMR measurement results.

FIG. 8 shows an example of NMR measurement results. Respective chemical shift amounts indicate numbers of coordinated atoms existing around aluminum assigned to each coordination number shown in FIG. 8. In the first example, the coordination element is oxygen.

Next, proportions of coordination conditions corresponding to the respective coordination numbers were determined by dividing each peak to calculate a surface area occupied by each peak. In the first example, tetracoordination occupied 15%, pentacoordination occupied 30%, and hexacoordination occupied 55%. In other words, it was confirmed that hexacoordination exists in a higher proportion than tetracoordination.

When the respective existence proportions of tetracoordination, pentacoordination, and hexacoordination are set as σ4, σ5, σ6, and when J=σ6/(σ4+σ6)×100, this means that if J is greater than 50%, the proportion of hexacoordination is higher than the proportion of tetracoordination, and if J is smaller than 50%, the proportion of hexacoordination is lower than the proportion of tetracoordination. In the first example, J=78%.

Further, a cross-section of the developing roller 14 was observed using a scanning electron microscope (SEM), and an average film thickness of the aluminum oxide film **14*b*2 serving as the surface layer was calculated from a 10 point average. In the first example, the average film thickness of the aluminum oxide film 14*b*2** was 0.30 μm.

Furthermore, in the present invention, an overall resistance (a volume resistance) of the developing roller 14 is preferably greater than $2\times10^4\Omega$ and smaller than $5\times10^6\Omega$. At or below $2\times10^4\Omega$, a current flowing through the rubber layer **14*b*1 serving as an elastic layer increases, leading to an increase in a required current amount. Further, at or above $5\times10^6\Omega$, a current that flows during development is likely to be obstructed. In the developing roller 14** according to the first example, the overall resistance was set at $5\times10^5\Omega$.

<<Method of Measuring Volume Resistance of Developing Roller>>

Figure 5:
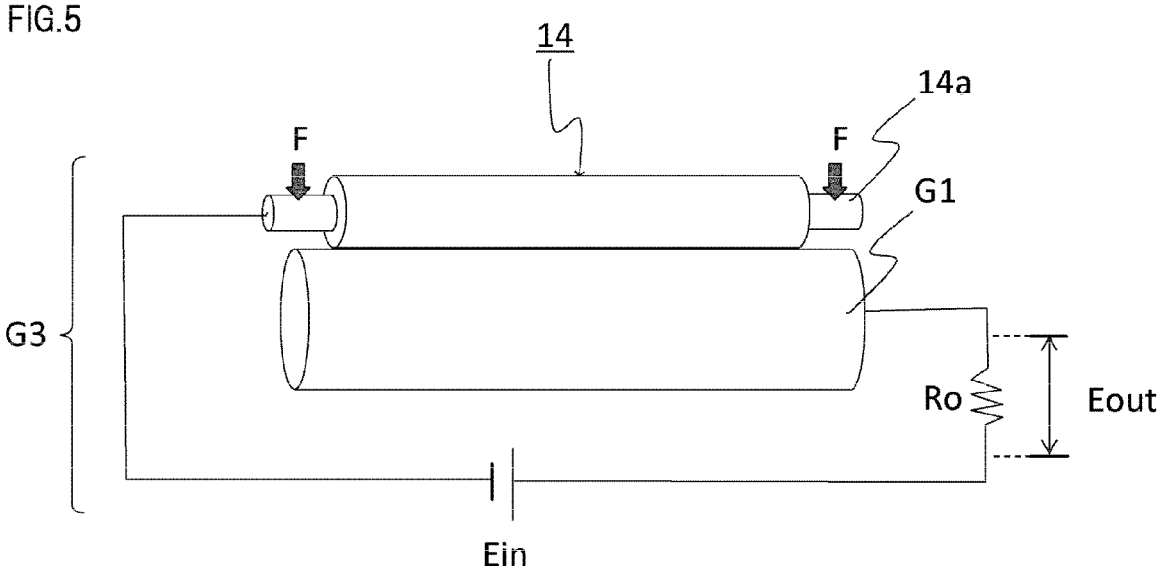
FIG. 5 is a view illustrating measurement of a volume resistance of the developing roller.

Next, using FIG. 5, a method of measuring the overall volume resistance of the developing roller 14 will be described. FIG. 5 is a view illustrating measurement of the overall volume resistance of the developing roller 14. As shown in FIG. 5, the roller 14 serving as a measurement subject has a multilayer structure constituted by the conductive core metal **14*a*, which is made of stainless steel or the like, the rubber layer 14*b*1, which is formed on an outer periphery thereof as the elastic layer, and the aluminum oxide film 14*b*2 serving as the surface layer. Further, a width of the developing roller 14** in a lengthwise direction is approximately 230 mm.

In this overall resistance measurement method, a cylindrical member G1 that is made of ϕ30 mm stainless steel and rotates at a speed of approximately 48 mm/sec is used. During resistance measurement, the developing roller 14 rotates in accordance with the rotation of the cylindrical member G1. An end portion roller (not shown) that limits a penetration level into the cylindrical member G1 (keeps a contact region between the roller 14 and the cylindrical member G1 constant) is fitted to an end portion of the developing roller 14. The end portion roller is formed in a cylindrical shape having an outer diameter of 80 μm, which is smaller than the outer diameter of the developing roller 14. F in FIG. 5 denotes a load exerted on respective end portions of the developing roller 14 (respective end portions of the conductive core metal **14*a*), and during measurement, the developing roller 14** is pressed toward the cylindrical member G1 side by a total load of 1 kg-force, i.e. 500 g-force on each side.

Further, a measurement circuit G3 shown in FIG. 5 is used in the measurement method. The measurement circuit G3 is constituted by a power supply Ein, a resistor Ro, and a voltmeter Eout. In this measurement method, measurement is performed at Ein: 300 V (DC). Further, a resistor having a resistance value of 100Ω to 10 MΩ can be used as the resistor Ro. Note that the resistor Ro is used to measure a weak current, and therefore preferably has a resistance value of between $10^{-2}$ times and $10^{-4}$ times the resistance of the developing roller 14 serving as the measurement subject. In other words, when the resistance value of the developing roller 14 is approximately $1\times10^6\Omega$, the resistance value of the resistor Ro is preferably approximately 1 kΩ. When the measurement circuit G3 is used, a resistance value Rb of the developing roller 14 is calculated from Rb=Ro×(Ein/Eout −1) Ω. Note that a value obtained ten seconds after applying a voltage was measured as Eout.

<<Measurement of Volume Resistivity of Surface Layer>>

Figure 6:
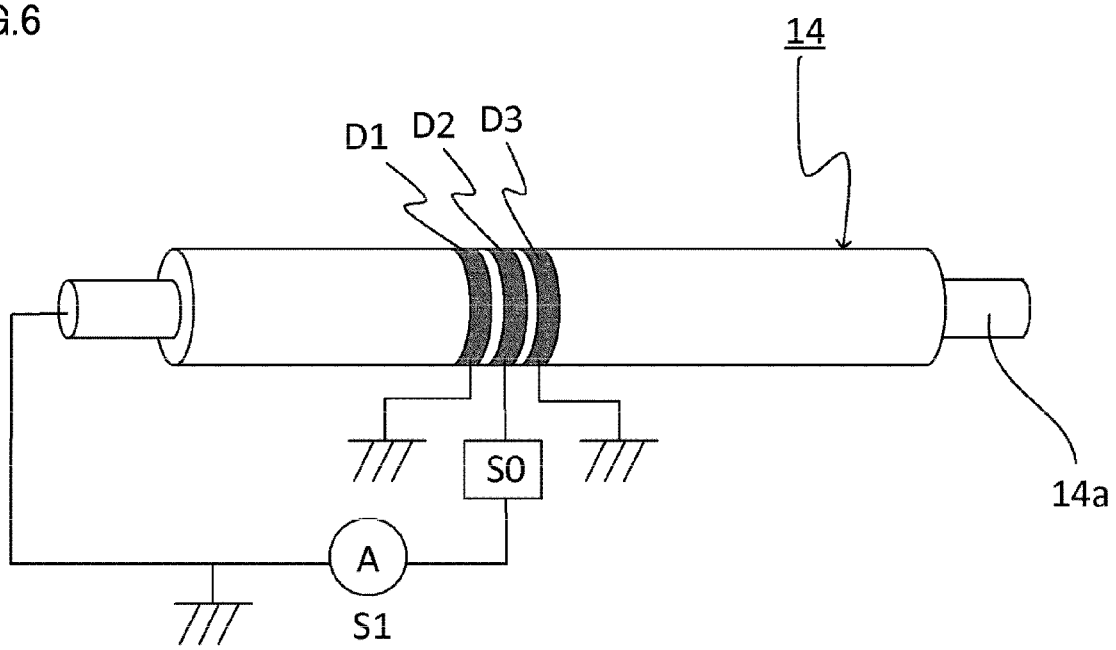
FIG. 6 is a view illustrating measurement of a volume resistivity of each layer of the developing roller.

Next, using FIG. 6, a volume resistivity of each layer of the developing roller will be described. FIG. 6 is a view illustrating measurement of the volume resistivity of each layer of the developing roller. In the first example, the volume resistivity of the surface layer is $5\times10^{13}$ Ωcm. The volume resistivity is measured as follows.

As shown in FIG. 6, three strips of conductive tape having a width of 5 mm are wound around the surface of the developing roller 14 at 1 mm intervals, whereupon a voltage to be described below, which is obtained by superimposing an alternating current on a direct current, is applied from a power supply S0 between the core metal electrode **14*a* of the developing roller 14** and a conductive tape D2 positioned in the center of the three strips of conductive tape.

The two strips of conductive tape D1 and D3 other than the central conductive tape D2 are grounded to earth, and the volume resistivity of the developing roller 14 in a radial direction is measured by detecting a current flowing between the central conductive tape D2 and the core metal electrode **14*a* using an ammeter S1. A direct current voltage of 20 V and an alternating current voltage of Vpp 1V are applied here and frequencies are varied from 1 Hz to 1 MeHz, and the volume resistance of each layer is calculated by plotting Col-Col. Further, a cross-section of the developing roller 14** is cut out, a film thickness of each layer is measured at 10 points using SEM observation, an average film thickness of each layer is calculated, and the volume resistivity of each layer is calculated from the aforesaid volume resistance. Here, impedance measurement was implemented in an environment of 30° C. and 80% RH.

<<Measurement of Hardness>>

A hardness (an average hardness) of the developing roller 14 was measured using an Asker-C durometer (manufactured by Kobunshi Keiki Co., Ltd.). The developing roller 14 used in the present invention preferably has an average Asker-C hardness of more than 30 degrees and less than 80 degrees (Asker-C). When the average hardness is equal to or higher than 80 degrees (Asker-C), the toner melts when it rubs against the developing roller 14, unfavorably leading to blade melt adhesion and roller melt adhesion. Further, a contact condition between the developing roller 14 and the photosensitive drum 1 is likely to become unstable. When the average hardness is equal to or lower than 30 degrees (Asker-C), on the other hand, permanent deformation occurs due to compression set, making the developing roller 14 difficult to use. Note that the average hardness of the developing roller 14 used in this example is set at 55 degrees (Asker-C).

DEVELOPING ROLLERS ACCORDING TO RESPECTIVE EXAMPLES AND COMPARATIVE EXAMPLES

Developing rollers 14 used in first to fourth comparative examples and second to fifth examples will be described below.

First Comparative Example

The developing roller 14 according to a first comparative example corresponding to the related art will now be described. The following description focuses mainly on differences with the first example. The developing roller 14 used in the first comparative example was manufactured as follows. A conductive silicon rubber layer containing a conductive agent was provided on the periphery of the core metal electrode 14*a* having an outer diameter of ϕ6 (mm) and serving as a conductive support member. The silicon rubber layer was coated with 10 μm of urethane resin through which roughening particles and a conductive agent were dispersed, whereby an overall outer diameter of the developing roller 14 was set at ϕ11.5 (mm). The resistance of the developing roller 14 was approximately $5\times10^5\Omega$, and the average hardness (Asker-C) was 55 degrees.

Second Comparative Example

The developing roller 14 according to a second comparative example will now be described. The following description focuses mainly on differences with the first example. The developing roller 14 used in the second comparative example was manufactured as follows. A conductive silicon rubber layer containing a conductive agent was provided on the periphery of the core metal electrode 14*a* having an outer diameter of ϕ6 (mm) and serving as a conductive support member. The silicon rubber layer was coated with 10 μm of urethane resin, whereby the overall outer diameter of the developing roller 14 was set at ϕ11.5 (mm). The resistance of the developing roller 14 was approximately $5\times10^6\Omega$, and the average hardness (Asker-C) was 55 degrees. Further, the surface layer resistivity was $1\times10^9$ Ωcm.

Third Comparative Example

The developing roller 14 according to a third comparative example will now be described. The following description focuses mainly on differences with the first example. The developing roller 14 used in the third comparative example was manufactured as follows. A conductive rubber layer containing a conductive agent was provided on the periphery of the core metal electrode 14*a* having an outer diameter of ϕ6 (mm) and serving as a conductive support member, whereby the outer diameter of the developing roller 14 was set at ϕ11.5 (mm). Further, an aluminum metal film of approximately 300 nm was formed as a conductive surface layer by subjecting the manufactured developing roller 14 to vacuum deposition. More specifically, the aluminum metal film was formed on the surface of the developing roller 14 by vaporizing Al metal through resistance heating. The resistance of the developing roller 14 was approximately $5\times10^5\Omega$, and the average hardness (Asker-C) was 55 degrees.

Second Example

The developing roller 14 according to a second example will now be described. The following description focuses mainly on differences with the first example. The developing roller 14 used in the second example was manufactured as follows. A rubber layer 14*b*1 serving as a conductive elastic layer containing a conductive agent was provided on the periphery of the core metal electrode 14*a* having an outer diameter of ϕ6 (mm) and serving as a conductive support member, whereby the outer diameter of the developing roller 14 was set at ϕ11.5 (mm). In the second example, urethane rubber was used. Next, the aluminum oxide film 14*b*2 serving as the surface layer was formed by a sputtering method. Here, the aluminum oxide film 14*b*2 was formed using aluminum metal as a raw material by introducing a mixed gas obtained by mixing together argon gas and oxygen gas at a concentration ratio of 90:10.

During material analysis of the surface layer, the existence of aluminum and oxygen was confirmed by X-ray photoelectron spectroscopy (XPS), whereupon respective proportions of conditions in which four, five, and six oxygen atoms are coordinated around an aluminum atom were calculated using solid-state nuclear magnetic resonance (solid-state NMR). Here, J=65%. The overall volume resistance of the developing roller 14 was approximately $5\times10^5\Omega$, and the average hardness (Asker-C) was 55 degrees. Further, the surface layer resistivity was $1\times10^{13}$ Ωcm. The average film thickness of the aluminum oxide film 14*b*2 was 0.30 μm.

Third Example

The developing roller 14 according to a third example will now be described. The following description focuses mainly on differences with the first example. The developing roller 14 used in the third example was manufactured as follows. The rubber layer 14*b*1 serving as a conductive elastic layer containing a conductive agent was provided on the periphery of the core metal electrode 14*a* having an outer diameter of ϕ6 (mm) and serving as a conductive support member, whereby the outer diameter of the developing roller 14 was set at ϕ11.5 (mm). In the third example, urethane rubber was used. Next, the aluminum oxide film 14*b*2 serving as the surface layer was formed by a sputtering method. Here, the aluminum oxide film 14*b*2 was formed using aluminum metal as a raw material by introducing a mixed gas obtained by mixing together argon gas and oxygen gas at a concentration ratio of 97:3.

During material analysis of the surface layer, the existence of aluminum and oxygen was confirmed by X-ray photoelectron spectroscopy (XPS), whereupon respective proportions of conditions in which four, five, and six oxygen atoms are coordinated around an aluminum atom were calculated using solid-state nuclear magnetic resonance (solid-state NMR). Here, J=51%. The overall volume resistance of the developing roller 14 was approximately $5\times10^5\Omega$, and the average hardness (Asker-C) was 55 degrees. Further, the surface layer resistivity was $2\times10^{11}$ Ωcm. The average film thickness of the aluminum oxide film 14*b*2 was 0.30 μm.

Fourth Comparative Example

The developing roller 14 according to a fourth comparative example will now be described. The following description focuses mainly on differences with the first example. The developing roller 14 used in the fourth comparative example was manufactured as follows. A conductive rubber layer containing a conductive agent was provided on the periphery of the core metal electrode 14*a* having an outer diameter of ϕ6 (mm) and serving as a conductive support member, whereby the outer diameter of the developing roller 14 was set at ϕ11.5

(mm). In the fourth comparative example, urethane rubber was used. Next, an aluminum oxide film serving as the surface layer was formed by a sputtering method. Here, the aluminum oxide film was formed using aluminum metal as a raw material by introducing a mixed gas obtained by mixing together argon gas and oxygen gas at a concentration ratio of 99:1.

During material analysis of the surface layer, the existence of aluminum and oxygen was confirmed by X-ray photoelectron spectroscopy (XPS), whereupon respective proportions of conditions in which four, five, and six oxygen atoms are coordinated around an aluminum atom were calculated using solid-state nuclear magnetic resonance (solid-state NMR). Here, J=40%. The overall volume resistance of the developing roller 14 was approximately $5\times10^{5}\Omega$, and the average hardness (Asker-C) was 55 degrees. Further, the surface layer resistivity was $5\times10^{10}$ Ωcm. The average film thickness of the aluminum oxide was 0.30 μm.

Fourth Example

The developing roller 14 according to a fourth example will now be described. The following description focuses mainly on differences with the first example. The developing roller 14 used in the fourth example was manufactured as follows. In the first example, the average film thickness of the aluminum oxide film **14*b*2 serving as the surface layer was 0.3 nm, whereas in the fourth example, the aluminum oxide film 14*b*2** was formed to have an average film thickness of 0.05 nm. All other configurations are identical to the first example.

Fifth Example

The developing roller 14 according to a fifth example will now be described. The following description focuses mainly on differences with the first example. The developing roller 14 used in the fifth example was manufactured as follows. In the first example, the average film thickness of the aluminum oxide film **14*b*2 serving as the surface layer was 0.3 μm, whereas in the fifth example, the aluminum oxide film 14*b*2** was formed to have an average film thickness of 1.0 μm. All other configurations are identical to the first example.

<<Evaluation Methods>>

An image density evaluation, a fog evaluation, and a solid density difference evaluation performed in cases where the developing rollers of the respective examples and comparative examples are applied to the image forming apparatus according to the first embodiment will be described below. Further, an initial fog evaluation and a halftone density evaluation performed in cases where the developing rollers of the respective examples and comparative examples are applied to the image forming apparatus according to the second embodiment will be described below. Hereafter, evaluations performed after passing 100 sheets will be referred to as "initial", and evaluations performed after passing 3000 sheets will be referred to as "durable".

<Evaluation Methods of First Embodiment>

Evaluation methods used in the first embodiment will now be described.

[Image Density Evaluation]

The image density evaluation was performed after leaving the image forming apparatus in an evaluation environment of 30° C. and 80% RH for one day in order to become accustomed to the environment, and after printing 100 sheets and 3000 sheets. The 100 sheet and 3000 sheet printing tests were performed by continuously passing sheets printed with a recorded image of horizontal lines having an image ratio of 5%. The evaluation obtained after passing 100 sheets was set as an initial image density, and the evaluation obtained after passing 3000 sheets was set as a durable image density.

Further, in the image density evaluation, three solid black images were output continuously, ten points were extracted in a sheet plane of the three solid black images, and an average value thereof was set as a solid black image density. Here, the solid image density was evaluated using a Spectrodensitometer 500 (manufactured by X-Rite Inc.). The printing tests and the evaluation images were output in monochrome at the normal sheet speed (120 mm/sec). The image density was evaluated using symbols ○, Δ, and x, described below.

○: A 10-point average on the solid black image of no less than 1.3

Δ: A 10-point average on the solid black image of no less than 1.1 and less than 1.3 x: A 10-point average on the solid black image of less than 1.1

[Fog Evaluation]

Fog is an image defect appearing as scumming when a small amount of toner is developed in a white portion (an unexposed portion) where printing is not intended. Fog is generated when the toner charge decays or the polarity of the toner reverses in the developing nip portion N where the photosensitive drum 1 contacts the developing roller 14. It is known that a charge-providing performance in relation to the toner deteriorates particularly in a high humidity environment. When the charge-providing performance in relation to the toner deteriorates, the charge of the toner decays, leading to an increase in the amount of fog.

A fog amount evaluation method was implemented as follows. An operation of the image forming apparatus was stopped during printing of a solid white image. Toner existing on the photosensitive drum 1 after the developing process and before the transfer process was transferred onto transparent tape, whereupon the tape carrying the toner was adhered to a recording sheet or the like. Tape not carrying toner was adhered to the same recording sheet simultaneously. An optical reflectance through a green filter was measured from above the tape adhered to the recording sheet using an optical reflectance gauge (TC-6DS, manufactured by Tokyo Denshoku), and an amount of reflectance corresponding to fog was determined by subtracting the measured optical reflectance from a reflectance of the tape not carrying the toner. The result was evaluated as the amount of fog. The amount of fog was measured at three or more points on the tape, and an average value thereof was determined. The fog was evaluated using symbols ○, Δ, x, and xx, described below.

○: A fog amount of less than 1.0%

Δ: A fog amount of no less than 1.0% and less than 3.0% x: A fog amount of no less than 3.0% and less than 5.0% xx: A fog amount of 5.0% or more

The fog evaluation was performed after leaving the image forming apparatus in a test environment of 30° C. and 80% RH for 24 hours, and after printing 100 sheets and 3000 sheets. The printing tests were performed by continuously passing sheets printed with a recorded image of horizontal lines having an image ratio of 5%. More specifically, an image formed by repeatedly printing one dot line and leaving nineteen dot lines unprinted was used here as an image of horizontal lines having an image ratio of 5%. Furthermore, the sheets were passed continuously at the normal speed (120 mm/sec), while the fog evaluation was implemented in the low speed mode (60 mm/sec). The evaluation obtained after passing 100 sheets was set as initial fog, and the evaluation obtained after passing 3000 sheets was set as durable fog.

[Solid Density Difference Evaluation]

The solid density difference evaluation was performed after leaving the image forming apparatus in an evaluation environment of 30.0° C. and 80% RH for 24 hours in order to become accustomed to the environment, and after printing 100 sheets. The 100 sheet printing test was performed by continuously passing sheets printed with a recorded image of horizontal lines having an image ratio of 5%. The solid density difference evaluation was performed by outputting a single solid black image and evaluating a density difference between a front end and a rear end of the output solid image using the Spectrodensitometer 500 (manufactured by X-Rite Inc.). The printing test and the evaluation image were output in monochrome at the normal sheet speed (120 mm/sec). The evaluation was made using symbols ○ and x, described below.

○: The density difference of the solid image between the sheet front end and the sheet rear end is less than 0.2 x: The density difference of the solid image between the sheet front end and the sheet rear end equals or exceeds 0.2

[Evaluation of Evenness of Halftone Image after Repeated Use]

The evenness of a halftone image after repeated use was evaluated after leaving the image forming apparatus in 30.0° C. and 80% RH for 24 hours in order to become accustomed to this environment, and after printing 3000 sheets. The 3000 sheet printing test was performed by continuously passing sheets printed with a recorded image of vertical lines having an image ratio of 5%. The printing test and the evaluation image were output in monochrome at the normal speed (120 ram/sec). The evaluation was made using the symbols ○ and x, described below. In this evaluation, the halftone image is a striped pattern obtained by recording a single line and then leaving four lines unrecorded in a main scanning direction. The halftone image represents an overall halftone density.

○: Vertical line-shaped grayscale unevenness cannot be recognized visually on the halftone image.

x: Vertical line-shaped grayscale unevenness can be recognized visually on the halftone image.

<Evaluation Methods of Second Embodiment>

Evaluation methods used in the second embodiment will now be described.

(Initial Fog Evaluation in Cleanerless System)

Initial fog in the cleanerless system according to the second embodiment was evaluated identically to the initial fog evaluation of the first embodiment, and therefore description thereof has been omitted.

[Initial Halftone Density Evaluation in Cleanerless System]

The initial halftone density in the cleanerless system according to the second embodiment was evaluated after leaving the image forming apparatus in an evaluation environment of 30.0° C. and 80% RH for 24 hours in order to become accustomed to the environment, and after printing 100 sheets. The 100 sheet printing test was performed by continuously passing sheets printed with a recorded image of horizontal lines having an image ratio of 5%. In the image evaluation, a single halftone image was printed. Next, twenty sheets printed with an image of a vertical stripe having a width of 2 cm were passed continuously, whereupon the halftone image was printed again onto a twenty-first sheet also passed continuously. The printing test and the evaluation image were output in monochrome at the normal speed (120 mm/sec). The halftone density was evaluated using symbols ○ and x described below. In this evaluation, the halftone image is a striped pattern obtained by recording a single line and then leaving four lines unrecorded in a main scanning direction. The halftone image represents the overall halftone density.

○: A density difference cannot be recognized visually between the halftone images on the first and twenty-first sheets.

x: A density difference can be recognized visually between the halftone images on the first and twenty-first sheets.

(Evaluation Results)

Table 1 shows results of the respective evaluations described above.

TABLE 1

| | Raw material | Surface layer manufacturing method | Atmosphere during film formation | Existence of Al and O (XPS) | Al coordination number ratio (hexacoordination/tetracoordination) | Film thickness [um] | Surface layer resistivity [Ω · cm] | Overall resistance [Ω] | Average hardness [degrees] (AskerC) |
|---|---|---|---|---|---|---|---|---|---|
| 1st example | Al2O3 | Vapor deposition | Vacuum | Al, O | 78 | 0.3 | 5 × 10^13 | 5 × 10^5 | 55 |
| 1st comparative example | — | — | — | — | — | — | — | 5 × 10^5 | 55 |
| 2nd comparative example | — | — | — | — | — | 10 | 1 × 10^9 | 5 × 10^6 | 55 |
| 3rd comparative example | Al | Vapor deposition | Vacuum | Al | — | 0.3 | Conductive | 5 × 10^5 | 55 |
| 2nd example | Al | Sputtering | 90:10 (O:Ar) | Al, O | 65 | 0.3 | 1 × 10^13 | 5 × 10^5 | 55 |
| 3rd example | Al | Sputtering | 97:3 (O:Ar) | Al, O | 51 | 0.3 | 2 × 10^11 | 5 × 10^5 | 55 |
| 4th comparative example | Al | Sputtering | 99:1 (O:Ar) | Al, O | 40 | 0.3 | 5 × 10^10 | 5 × 10^5 | 55 |
| 4th example | Al2O3 | Vapor deposition | Vacuum | Al, O | 78 | 0.05 | 5 × 10^13 | 5 × 10^5 | 55 |
| 5th example | Al2O3 | Vapor deposition | Vacuum | Al, O | 78 | 1.0 | 5 × 10^13 | 5 × 10^5 | 55 |

TABLE 1-continued

| | 1st embodiment | | | | | 2nd embodiment | |
|---|---|---|---|---|---|---|---|
| | Initial image density | Durable image density | Initial fog | Durable fog | Solid density difference | Initial fog | Halftone density |
| 1st example | ○ | ○ | ○ | ○ | ○ | ○ | ○ |
| 1st comparative example | ○ | X | X | XX | ○ | XX | X |
| 2nd comparative example | Δ | X | Δ | X | ○ | XX | X |
| 3rd comparative example | ○ | Δ | ○ | Δ | X | X | X |
| 2nd example | ○ | ○ | ○ | ○ | ○ | ○ | ○ |
| 3rd example | ○ | ○ | ○ | Δ | ○ | ○ | ○ |
| 4th comparative example | ○ | ○ | Δ | X | ○ | X | X |
| 4th example | ○ | ○ | ○ | Δ | ○ | Δ | ○ |
| 5th example | ○ | ○ | ○ | Δ | ○ | ○ | ○ |

First, the first example and the first comparative example will be compared on the basis of the evaluation results of the first embodiment.

First, the results of the fog evaluation will be described. As shown on Table 1, in the evaluation results of the first embodiment, an increase in the amount of fog is observed in the first comparative example, which uses the developing roller 14 not having a surface layer. The reason for this is believed to be that the toner charge decays by a large amount in the developing nip portion N.

Figure 7:
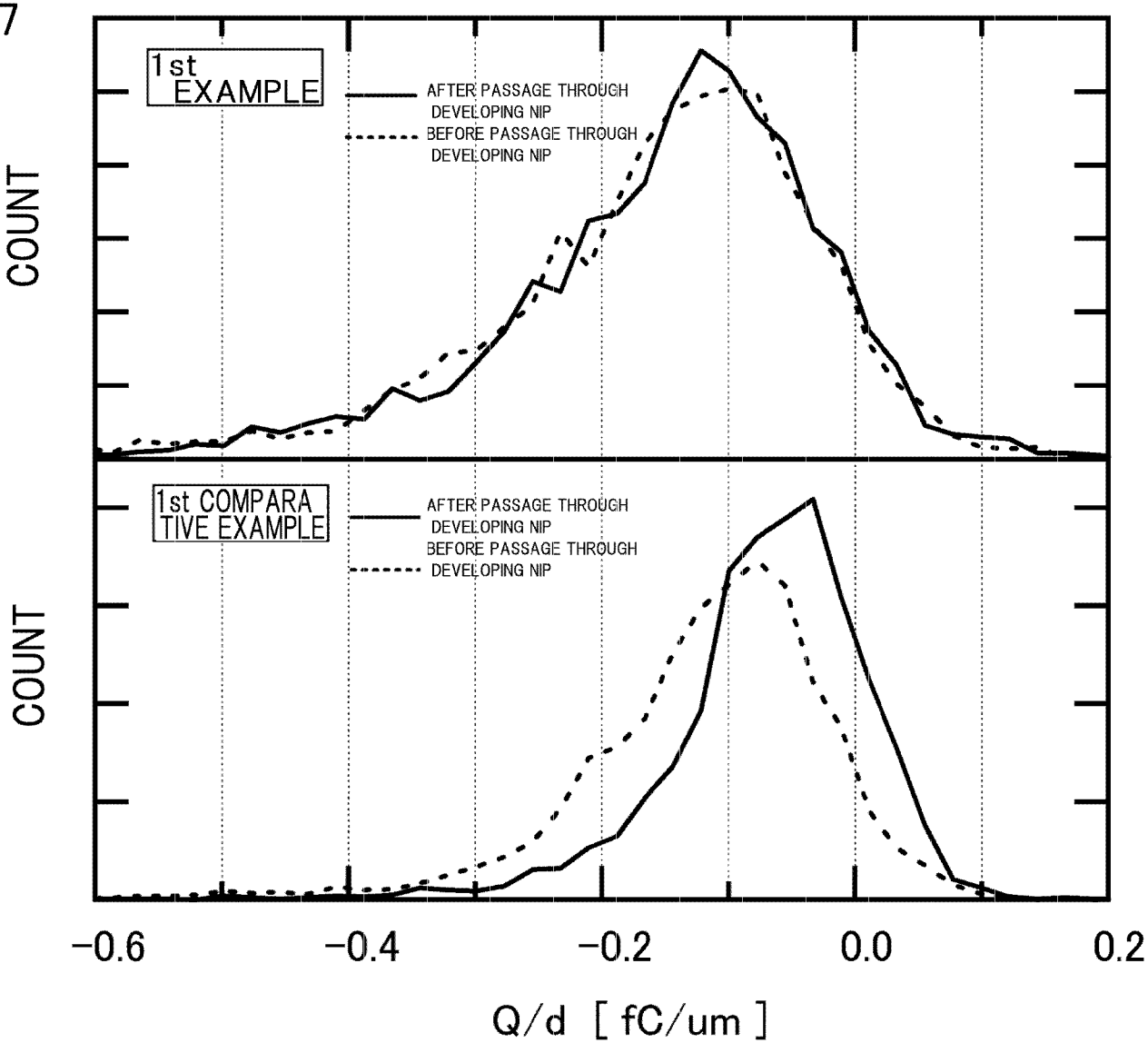
FIG. 7 is a graph showing a charge amount of a toner coating layer before and after passage through a developing nip portion.

Here, using FIG. 7, the charge amount of the toner coating layer on the developing roller 14 before and after passage through the developing nip portion N will be described. FIG. 7 is a graph showing the charge amount of the toner coating layer before and after passage through the developing nip portion according to the first example and the first comparative example.

The abscissa in FIG. 7 shows Q/d [fC/μm]. Q is the charge amount of one toner sample, and d is a toner particle diameter, which was measured using an E-spart analyzer, manufactured by Hosokawa Micron Group. In the fog evaluation, the toner charge amount was measured after sampling 100 continuously passed sheets. As is evident from FIG. 7, in the first comparative example, the toner charge amount following passage through the developing nip portion N is much smaller than the toner charge amount before passage through the developing nip portion N. The reason for this is believed to be that when the toner coating layer passes through the developing nip portion N, the toner charge diffuses to the developing roller 14 side.

In the first example, on the other hand, the amount by which the toner charge amount decreases following passage through the developing nip portion N is extremely small. Furthermore, the toner charge amount before the developing nip portion N is larger in the first example than in the first comparative example. The reason for this is that the aluminum oxide used as the surface layer exhibits a superior charge-providing performance.

In the first comparative example, the charge-providing performance in relation to the toner deteriorates as deterioration of the toner advances following repeated use. As a result, the amount of fog increases dramatically. In the first example of the present invention, on the other hand, the amount of fog is suppressed even after repeated use. In the first example, toner charge decay is suppressed effectively by forming the high-resistance surface layer. In particular, toner charge decay in the developing nip portion N is suppressed even when the charge-providing performance in relation to the toner decreases after repeated use, and therefore the amount of fog can be suppressed. In addition, the aluminum oxide used as the surface layer exhibits a superior ability to charge the toner negatively, and therefore an increase in the amount of fog can be suppressed dramatically.

Next, the results of the image density evaluation will be described. As shown on Table 1, the initial image density is favorable in both the first example and the first comparative example. In the first example, the high-resistance surface layer is formed as a thin layer, and therefore a similar image density to that of a conventional image forming apparatus can be obtained. In the first comparative example, however, the image density decreases after repeated use. The reason for this is believed to be that after repeated use, the toner charging ability deteriorates, leading to a reduction in transfer efficiency, and therefore the amount of toner reaching the sheet decreases, causing a reduction in image density.

Furthermore, in the first embodiment, a potential difference is provided between the developing roller 14 and the regulating blade 16 in order to stabilize the toner coating layer on the developing roller 14. The potential difference is provided in a direction for pushing a negative charge toward the developing roller 14 side, and therefore a force acts to orient the negatively charged toner and the charge on the toner surface toward the developing roller 14 side. Accordingly, toner charge decay occurs likewise in a blade nip portion where the regulating blade 16 contacts the developing roller 14, leading to a dramatic reduction in the toner charge amount. As a result, toner having a smaller charge amount is supplied to the drum, and therefore the toner is less likely to move in a transfer nip portion (an opposing position between the photosensitive drum 1 and the primary transfer apparatus 5).

In the first example, in addition to the charge-providing performance of the aluminum oxide, toner charge decay can be suppressed with stability in the developing nip portion N and the blade nip portion where the toner contacts the regulating blade 16 even when the toner deteriorates after repeated use such that the charge-providing performance in relation to the toner decreases. Hence, superior transferability can be maintained, and as a result, a reduction in density following repeated use can be suppressed.

Next, the evaluation results of the second embodiment will be described.

The second embodiment is an example in which the cleaning blade 9 is not provided, and therefore untransferred toner remaining on the photosensitive drum 1 is charged negatively while passing the charging roller 2 and then collected by the developing assembly 4 in the developing nip portion N. Further, in this example, Vback is increased to as high as 500 V in order to improve a collection performance by which return toner is collected in the developing nip portion N. In the first comparative example corresponding to the related art, since Vback is large, a large amount of toner charge decay occurs during passage through the developing nip portion N, and as a result, an increase in the amount of fog is observed. Moreover, in the first comparative example, in addition to the large amount of fog, the amount of residual toner that cannot be transferred is large, and therefore an extremely large amount of toner reaches a contact region between the charging roller 2 and the photosensitive drum 1. Hence, a large amount of toner accumulates on the surface of the charging roller 2, and therefore a desired charging performance cannot be obtained. As a result, variation occurs in the halftone image density.

In the first example of the present invention, on the other hand, since Vback is large in the second embodiment, a favorable image can be obtained even though the toner charge is more likely to decay during passage through the developing nip portion N. The reason for this is that in the first example of the present invention, toner charge decay can be suppressed effectively and the charge-providing ability in relation to the toner is favorable, and therefore an increase in the amount of fog can be suppressed dramatically. Accordingly, superior transferability can be maintained, and therefore the amount of residual untransferred toner can be reduced dramatically. As a result, variation in the halftone image density caused by soiling of the charging roller can be suppressed.

With the developing roller 14 according to the first example of the present invention, described above, favorable images can be obtained with stability in both embodiments. In the cleanerless system of the second embodiment, the amount of untransferred toner remaining on the photosensitive drum 1 can be suppressed dramatically, and therefore soiling of the charging roller 2 can be suppressed. Even when Vback is set to be large in order to improve the collecting performance, the amount of fog can be suppressed, and therefore the untransferred residual toner can be collected in the developing assembly 4 effectively.

(Superiority of First and Second Examples of the Present Invention)

The superiority of the first and second examples of the present invention over the first to fourth comparative examples will now be described.

In the first embodiment, the amount of fog occurring in the second comparative example, although smaller than that of the first comparative example, remains large. In the second comparative example, a urethane layer not containing carbon is provided as the surface layer in order to suppress the amount of toner decay during passage through the developing nip portion N. Hence, the amount of charge decay following passage is slightly reduced, and therefore an increase in the amount of fog is suppressed.

However, the charge-providing performance in relation to the toner is poor, and therefore, with the cleanerless system serving as the second embodiment, the amount of fog increases in a similar manner to the first comparative example. The transferability is also poor, and therefore variation occurs in the halftone image density due to soiling of the charging roller. Moreover, in the second comparative example, although the overall volume resistance of the developing roller 14 is made large enough to suppress decay of the toner charge amount during passage through the developing nip portion N, a desired strength of charge required for development cannot be obtained, and therefore a slight reduction also occurs in the initial image density. Furthermore, following repeated use, the toner charge amount decreases due to toner deterioration, leading to a reduction in the transferability and a further reduction in the image density.

In the third comparative example, the aluminum metal film serving as the surface layer covers the surface in order to improve the charge-providing performance. Since the average film thickness of the layer is only 0.30 μm, initial image density variation is not observed. Further, in the first embodiment, the charge-providing performance is favorable, and therefore an increase in the amount of fog is also suppressed. However, since the surface layer is formed with a low resistance, the toner charge decays during passage through both the developing nip portion N and the blade nip portion. As a result, when deterioration of the toner advances due to repeated use such that the toner charging performance deteriorates, the amount of fog increases, and the image density decreases due to deterioration of the transferability.

Further, in the cleanerless system of the second embodiment, Vback is large, and therefore the toner charge decays greatly during passage through the developing nip portion N, leading to an increase in the amount of fog. Accordingly, the fog toner reaches and accumulates on the charging roller 2 without being transferred, and as a result, variation occurs in the halftone image density due to a reduction in the transferability. Further, the toner that is returned to the developing assembly 4 without being developed is normally peeled away by the supply roller 15 such that the toner on the developing roller 14 is refreshed, and as a result, a development history is suppressed.

In the third comparative example, the charge-providing performance in relation to the toner is extremely high, and therefore the toner is not peeled away favorably by the supply roller 15. As a result, a density difference occurs in the solid density between the front end and the rear end. The reason why a density difference occurs in the solid image between the front end part of the solid image, which is generated during a single rotation of the developing roller, and a part generated thereafter when the peeling performance deteriorates can be described briefly as follows.

When the toner peeling performance is poor, the part corresponding to a single rotation of the developing roller is held on the developing roller 14 for several rotations without being printed by a previous rotation or the like prior to formation of the image. As a result, excessively charged toner and toner having a small particle diameter, which is more difficult to peel away, are likely to accumulate. As regards the solid image generated by a second rotation of the developing roller onward, on the other hand, the toner is supplied to the developing roller 14 from the supply roller 15 so as to be immediately supplied to the developing roller 14. Accordingly, the toner charge amount, the particle diameter, and so on of toner coating layer differ from previous values. As a result, when the solid image is printed, a difference in density occurs between the part generated by a single rotation of the developing roller and the subsequent part.

In the first example of the present invention, on the other hand, the aluminum oxide film is formed as the surface layer, and therefore the toner is charged with an appropriate charge-providing performance. Accordingly, toner charge decay during passage through the developing nip portion N is suppressed, and therefore the amount of fog can be suppressed with stability. Further, the amount of fog can be suppressed without applying an excessive charge amount, and therefore the peeling performance of the supply roller 15 can be maintained. Hence, a difference in solid image density due to the development history can be suppressed, and as a result, stable images can be obtained.

(Relationships Between Coordination Number Around Aluminum, Resistivity of Aluminum Oxide Surface Layer, and Surface Layer Film Thickness)

Relationships between the coordination number around aluminum, the resistivity of the aluminum oxide surface layer, and the surface layer film thickness will now be described by comparing the first to third examples and the fourth comparative example.

The index J expressing the existence ratio between hexacoordination and tetracoordination is set such that when J=100%, only hexacoordination exists, when J=0%, only tetracoordination exists, and when J=50%, the ratio between hexacoordination and tetracoordination is 1:1. In other words, the value of J, and therefore the existence proportion of hexacoordination, decreases steadily in order of the first, second, and third examples and the fourth comparative example. Further, the volume resistivity of the aluminum oxide forming the surface layer decreases correspondingly.

The inventors found, through committed research, that the volume resistivity of the aluminum oxide forming the surface layer increases as the existence proportion of hexacoordination increases relative to tetracoordination. The reason for this can be described briefly as follows.

It is known that among aluminum oxides, α-alumina takes a corundum structure and exhibits a superior insulating property. Further, hexacoordination is the only coordination number of oxygen atoms around aluminum. On the other hand, γ-alumina, which has a lower resistance than α-alumina, takes a spinel structure, and tetracoordination and hexacoordination coexist therein as the coordination numbers of oxygen atoms around aluminum.

The aluminum oxide used as the surface layer according to the examples is formed into a layer by vacuum deposition or sputtering, and is therefore assumed to be in an amorphous condition where α-alumina and γ-alumina structures coexist. It is therefore believed that when hexacoordination, which exhibits a superior insulating property, is increased, a high-resistance film generated from α-alumina can be formed.

It is also known that α-alumina is generated at high temperatures of no lower than 1000° C. In the developing roller 14 according to the examples, urethane rubber, silicon rubber, or the like is used as the elastic layer, and therefore only the required amount of heat can be applied. With the film formation method according to the examples, the aluminum oxide serving as the high resistance surface layer can be formed easily without affecting the rubber of the elastic layer.

In the first and second examples having the high-resistance surface layer, favorable images can be obtained with stability in both embodiments. Note that in the third example, the existence proportion of hexacoordination is small, and therefore a low resistance film is formed, leading to a slight increase in the amount of fog following repeated use. Further, in the fourth comparative example, where the existence proportion of hexacoordination is smaller than the existence proportion of tetracoordination, a sufficient insulating property cannot be obtained, and therefore the amount of fog increases. Hence, to form a stable, high-resistance film, the existence proportion of hexacoordination is preferably higher than that of tetracoordination, and the index J expressing the existence ratio between tetracoordination and hexacoordination is preferably no lower than 65%. Furthermore, the volume resistivity of the surface layer is preferably no lower than $10^{11}$ Ωcm and no higher than $10^{14}$ Ωcm.

In the fourth and fifth examples having high-resistance layers on which J=78%, the amount of fog increases slightly following repeated use. In the fourth example, the film thickness of the aluminum oxide is, at 50 nm, extremely thin. Since the surface layer is formed, an increase in the amount of fog is not observed initially. Following repeated use, however, the film thickness decreases due to wear and so on, and therefore the toner charge amount decay suppression effect in the developing nip portion N deteriorates, leading to a slight increase in the amount of fog. Even when Vback is set to be high, as in the second embodiment, the toner charge amount decay suppression effect is small, and therefore the amount of fog increases slightly.

In the fifth example, the thicker aluminum oxide having an average film thickness of 1.0 μm is formed as the surface layer, and therefore a large toner charge amount decay suppression effect is obtained such that initial fog is favorable in both embodiments. However, a slight increase in durable fog is observed. The reason for this is believed to be that the average hardness of the developing roller 14 is set between 30 and 80 degrees such that elastic deformation occurs in the developing roller 14 extremely easily. The developing roller 14 deforms upon contact with the photosensitive drum 1 and the regulating blade 16, and therefore stability is achieved in the contact and in the development process.

The aluminum oxide film **14*b*2 of the fifth example does not deform as flexibly as the rubber layer 14*b*1**. In the fifth example, the aluminum oxide serving as the surface layer cannot follow the deformation of the rubber layer, and therefore cracks form increasingly after repeated use. When cracks form, moisture is absorbed into the crack portions, and the toner charge escapes to the developing roller side through the absorbed moisture. As a result, the toner charge decay suppression effect in the developing nip portion N decreases after repeated use, leading to a slight increase in the amount of fog.

Hence, to obtain a high-resistance layer that follows the deformation of the developing roller 14 and suppresses toner charge amount decay in the developing nip portion N, the average film thickness is preferably no smaller than 0.05 μm and no greater than 1.0 μm. Further, to enable more stable film formation, the average film thickness is preferably no smaller than 0.1 μm and no greater than 0.5 μm.

In the first to fifth examples of the present invention, as described above, the developing roller 14 includes a surface layer containing aluminum oxide. The aluminum oxide contains tetracoordinated aluminum atoms and hexacoordinated aluminum atoms existing in a higher proportion than the tetracoordinated aluminum atoms. Accordingly, the volume resistivity of the surface layer is high. Hence, in the examples of the present invention, by providing the developing roller 14 with a high-resistance surface layer, a development performance can be maintained while suppressing fog.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-235292, filed on Nov. 13, 2013, which is hereby incorporated by reference herein in its entirety.

What is claimed is:

1. A developer carrying member that is capable of carrying a developer on a surface thereof, and that supplies the developer carried on the surface to a surface of an image bearing member when a voltage is applied thereto, comprising:

an elastic layer; and a surface layer that covers the elastic layer and contains aluminum oxide, wherein the aluminum oxide of the surface layer contains tetracoordinated aluminum atoms and hexacoordinated aluminum atoms existing in a higher proportion than the tetracoordinated aluminum atoms.

2. The developer carrying member according to claim 1, wherein a volume resistance is greater than $2\times10^4$ Ω and smaller than $5\times10^6$ Ω.

3. The developer carrying member according to claim 1, wherein a volume resistivity of the surface layer is no smaller than $10^{11}$ Ωcm and no larger than $10^{14}$ Ωcm.

4. The developer carrying member according to claim 1, wherein a thickness of the surface layer is no smaller than 0.05 μm and no larger than 1.0 μm.

5. The developer carrying member according to claim 1, wherein a thickness of the surface layer is no smaller than 0.1 μm and no larger than 0.5 Ωm.

6. The developer carrying member according to claim 1, wherein an Asker-C hardness is higher than 30 degrees and lower than 80 degrees.

7. The developer carrying member according to claim 1, wherein the developer is a single component non-magnetic toner.

8. A developing assembly comprising:

a developer container housing a developer; and the developer carrying member according to claim 1.

9. A process cartridge that can be attached to a main body of an image forming apparatus detachably in order to perform an image formation process, comprising:

an image bearing member capable of bearing a developer image; and the developer carrying member according to claim 1, which forms the developer image by developing an electrostatic latent image on the image bearing member.

10. An image forming apparatus comprising:

an image bearing member capable of bearing a developer image;

the developer carrying member according to claim 1, which forms the developer image by developing an electrostatic latent image on the image bearing member; and applying means for applying a voltage to the developer carrying member.

* * * * *